US007815073B1

(12) United States Patent
Fairchild

(10) Patent No.: US 7,815,073 B1
(45) Date of Patent: Oct. 19, 2010

(54) CONVENIENCE CONTAINER DEVICES AND METHODS THEREOF

(76) Inventor: Jesse J. Fairchild, 6095 N. Serene Dr., Las Vegas, NV (US) 89130

( * ) Notice: Subject to any disclaimer, the term of this patent is extended or adjusted under 35 U.S.C. 154(b) by 631 days.

(21) Appl. No.: 11/828,309

(22) Filed: Jul. 25, 2007

(51) Int. Cl.
*B67D 7/74* (2010.01)

(52) U.S. Cl. ..... 222/129; 220/212; 294/55; 206/219; 426/115; 426/394; 222/143; 414/9

(58) Field of Classification Search ..... 222/129, 222/143; 220/212, 212.5, 506; 426/115, 426/394; 206/219, 222, 541; 294/49–60; 414/9

See application file for complete search history.

(56) References Cited

U.S. PATENT DOCUMENTS 4,325,187 A * 4/1982 Wasson ..... 30/327
5,597,189 A * 1/1997 Barbee, Sr. ..... 294/25
6,105,254 A * 8/2000 Crane et al. ..... 30/128
6,116,455 A 9/2000 Rossman et al.
6,196,406 B1 * 3/2001 Ennis ..... 220/23.83
6,264,068 B1 * 7/2001 Ours et al. ..... 222/129
6,354,456 B2 3/2002 Rapson
6,913,777 B2 7/2005 Rebhorn et al.
6,971,521 B2 * 12/2005 Pinyot ..... 206/503
7,063,229 B2 6/2006 Westerhoff et al.

* cited by examiner

*Primary Examiner*—Kevin P Shaver
*Assistant Examiner*—Andrew P Bainbridge
(74) *Attorney, Agent, or Firm*—Landaleip, Inc.; David Landman

(57) ABSTRACT

A convenience container device is disclosed. The device has a food container selectively coupled to a lid assembly. The lid assembly includes a spoon at an end of a handle pivotally coupled to a trigger handle. The food container comprises one or more chambers, and the chambers include solid foods and fluid foods. The chambers communicate with one another so that the solid foods and the fluid foods are mixed. Single-handed manipulation of the trigger handle by a user displaces the spoon having a mixture of the solid and fluid foods along a predefined path to conveniently deliver the food mixture to the user. A method of using the convenience container device is disclosed. Furthermore, a convenience consumer device kit comprises one or more convenience container devices or one or more components of one or more convenience consumer devices, or combinations thereof.

20 Claims, 9 Drawing Sheets

CONVENIENCE CONTAINER DEVICES AND METHODS THEREOF

FIELD OF THE INVENTION

This invention generally relates to convenience food containers, and more specifically, to container devices configured to permit single-handed dispensing of meals and methods that facilitate dispensing of meals from the convenience container devices.

BACKGROUND OF THE INVENTION

In the past, there have been a number of containers that have been disclosed which store and conveniently dispense food. Generally, such containers provide a convenience meal to consumers who are limited in time or due to other situations to eat solid or semi-solid food in an unconventional manner.

Of course, fluids (some of which are relatively nutritious) are readily available to consumers simply because of the packaging of such items in various types of disposable aluminum or plastic containers. In the case of fluids, the containers may be readily used in a single-handed operation. Some containers configured with solid or semi-solid foods aim to provide single-handed operation whenever possible, but often do not provide the convenience sought by consumers. Often it is desirable to serve more than one type of food (in other words a balanced meal) which requires some element of mixing of the food types prior to their consumption.

By way of example, Westerhof et al., U.S. Pat. No. 7,063,229 (hereinafter Westerhof) discloses a single handed container for mixing foods. According to the Westerhof disclosure, the container has an outer cup and an inner cup which are fitted with a lid that seals the inner cup in the outer cup with a space between the two cups. The space between the outer cup and the inner cup contains a fluid such as milk. The inner cup holds a cereal. The inner cup has a plurality of walls to permit flow of the cereal from the inner cup. Additionally, the lid has an opening in communication with the inner and outer cup, and the opening is designed so that the cups may be tilted and a consumer may then receive the cereal and milk. Of course, limited mixing action occurs so that in effect the consumer simply receives dry cereal with a little bit of milk. In this situation, although the operation is single-handed, the meal experience differs significantly from consuming cereal and milk from a bowl with a spoon.

Other U.S. patent disclosures mentioned by Westerhof do not appear to provide any different kind of eating experience and depend on various mechanisms, which are dissimilar to how people generally consume their food.

Accordingly, it would appear that to date, no disclosure has provided a practical solution to the issue of how to provide a convenience container that may be used in a single-handed fashion and also be similar to the way a consumer would generally eat a meal comprising one or more solid or semi-solid components and fluids. Furthermore, devices that have been disclosed appear to be fairly complex and consequently may be expensive to implement.

SUMMARY OF THE INVENTION

For the foregoing reasons, there is a need to provide improved convenience containers that may be used in a single-handed fashion to eat a meal comprising one or more food solid or semi-solid components and fluids.

In accordance with an embodiment of this invention, a convenience container device is disclosed. The device comprises in combination, a food container selectively coupled to a lid assembly, which may include a spoon at an end of a handle and an opposite end of the handle may be pivotally coupled to a trigger handle. The food container has an outer wall and at least one food opening. The food container may include one or more chambers located in an inner portion of the food container. Furthermore, a first chamber may have at least one outlet and the first chamber may be defined by at least one wall. A second chamber may be defined by a wall. A third chamber may have at least one outlet and the third chamber may be defined by at least one wall. Furthermore, the device may have a tube having a first end and a second end. An inner portion of the second chamber may receive a portion of the first end of the tube. Furthermore, the tube may be in fluid communication with an inner portion of the third chamber, which may receive a portion of the second end of the tube. An inner portion of the third chamber may be in selective communication with the at least one outlet of the first chamber. When a user selectively engages the trigger handle with a single hand to manipulate the spoon, the spoon may be selectively displaced along a predefined path from an inner portion of the third chamber through the food opening and thereby conveniently delivers a food mixture of one or more food solids and one or more food fluids to the user.

In another aspect of the disclosure, the lid assembly may further comprise a lid having a guide and at least one pivot on a portion of the lid. The guide may be configured to manipulate a portion of the handle along the predefined path. Furthermore, each of an opposite end of the handle and an end of the trigger handle may be coupled to a portion of the at least one pivot, and a portion of the trigger handle may couple to a second pivot on a portion of the lid.

In yet another aspect of the disclosure, the device may further comprise at least one solid food in an inner portion of the first chamber and at least one fluid food in an inner portion of the second chamber. The device may also comprise a mixing region of an inner portion of the third chamber with the mixing region configured to receive a portion of at least one solid food from an inner portion of the first chamber and a portion of at least one fluid food from an inner portion of the second chamber. At least one outlet of the first chamber may be elevated to prevent the at least one fluid food from entering into an inner portion of the first chamber, which maintains dryness of the at least one solid food located in an inner portion of the first chamber. Furthermore, a portion of an outer surface of the outer wall of the food container may be sized to receive a portion of the trigger handle.

In another aspect of the device, a portion of the second end of the tube may comprise at least a first bifurcated tube separated from at least a second bifurcated tube. In this embodiment, the second end of the tube and the first end of the tube may have a substantially Y shape.

In another aspect, a portion of a surface of the outer wall of the food container may have an indentation. The indentation may be shaped to receive a portion of an outer surface of a lid assembly of another convenience container device to facilitate efficient stacking of one or more convenience container devices.

In yet another aspect of the device, an outer portion of the first chamber may comprise a first bifurcated member and a second bifurcated member, which may facilitate unobstructed movement of a portion of the spoon and the handle between the first bifurcated member and the second bifurcated member of the first chamber along the predefined path.

In another aspect of the device, the device may further comprise a fourth chamber having an inner channel defined by a portion of a bowl shaped outer wall of the food container.

The inner channel may be in communication with an inner portion of third chamber. The inner channel may be configured to receive the food mixture of one or more solid foods and one or more fluids from an inner mixing region of the third chamber.

Further, the device may comprise a separator member. A side of the separator member may comprise an inner portion of the first chamber and an opposite side of the separator member may comprise an inner portion of the second chamber.

In yet another aspect the device may comprise a portion of one or more sealant assemblies coupled to a portion of at least one outlet of the first chamber. The one or more sealant assemblies may hygienically secure one or more solid foods in an inner portion of the first chamber. Furthermore, each of the one or more sealant assemblies may have at least one tab configured to selectively decouple a portion of the one or more sealant assemblies from a portion of at least one outlet of the first chamber. Similarly, a portion of the one or more sealant assemblies may be selectively coupled to a portion of the second end of the tube and may hygienically secure one or more fluid foods in an inner portion of the second chamber. The at least one tab may also be configured to selectively decouple a portion of the one or more sealant assemblies from a portion of the second end of the tube.

In accordance with another embodiment of this invention, a method of dispensing a mixture of solid foods and fluid foods is disclosed. The method comprises a number of steps. A convenience container device having one or more sealant assemblies may be provided. The convenience container device may include a food container selectively coupled to a lid assembly. The lid assembly may include a spoon at an end of a handle. An opposite end of the handle may be pivotally coupled to a trigger handle. The food container may have an outer wall and at least one food opening. A portion of at least one of the sealant assemblies may be removed from a portion of at least one outlet of a first chamber of the food container to expose one or more food solids located in an inner portion of the first chamber. A portion of the at least one sealant assemblies may be removed from a portion of a second end of a tube having a first end in selective fluid communication with one or more fluid foods located in an inner portion of a second chamber to expose the one or more fluid foods. The convenience container device may be rotated to facilitate selective dispensing of a portion of the one or more food solids from an inner portion of the first chamber through the at least one outlet of the first chamber into an inner portion of a third chamber. Further, the convenience container device may be rotated back to manipulate the one or more solid foods into a mixing region of the third chamber, wherein at least a portion of the spoon may be configured to receive a portion of the one or more solid foods. In yet another step of the method, a portion of the one or more fluid foods may be selectively forced from an inner portion of the second chamber through the first end of the tube and out of the second end of the tube into an inner portion of the third chamber to mix with a portion of the one or more food solids in the mixing region of the third chamber. A portion of the spoon may be configured to receive a food mixture of the one or more solid foods and the one or more fluid foods. In yet another step, the trigger handle may be selectively engaged with a user's single hand to displace the spoon along a pre-determined path from the mixing region and through the food opening to feed the user with a portion of the food mixture.

In a further aspect of the disclosure, the method may further comprise further steps. In one step the trigger handle may be selectively disengaged, and the spoon may retrace a portion of the pre-determined path back through the food opening and partially back into an inner portion of the third chamber. Furthermore, the spoon may be reloaded with a portion of the food mixture located between the mixing region and an inner portion of a fourth chamber in communication with an inner portion of the third chamber. In yet another step, the trigger handle may be selectively re-engaged with the user's single hand to re-feed the user with another portion of the food mixture. In yet another step, the trigger handle may be disengaged to retract the spoon into the mixing region of the third chamber.

In accordance with yet another embodiment of this invention, a convenience container device kit is disclosed. The kit comprises in combination, at least two convenience container devices wherein each of the convenience container devices may be configured to single handedly dispense a mixture of one or more solid foods and one or more fluid foods along a predefined path. Each of the at least two convenience container devices may include a food container selectively coupled to a lid assembly. The lid assembly may include a spoon at an end of a handle. An opposite end of the handle may be pivotally coupled to a trigger handle.

Furthermore, regarding the kit, the food container may have an outer wall and at least one food opening. The food container may include one or more chambers located in an inner portion of the food container. A first chamber may be defined by at least one wall and the first chamber may have at least one outlet. A second chamber may defined by at least one wall and, a third chamber may defined by at least one wall. The third chamber may have at least one outlet. In another aspect of the kit, the food container may further include a tube having a first end and a second end. An inner portion of the second chamber may be configured to receive a portion of the first end of the tube, and the tube may be in selective fluid communication with an inner portion of the third chamber. The inner portion of the third chamber may be configured to receive a portion of the second end of the tube. Further, an inner portion of the third chamber may be in selective communication with the at least one outlet of the first chamber. A portion of a surface of the outer wall of each food container of the convenience consumer devices may have an indentation. The indentation may be shaped to receive a portion of an outer surface of a lid assembly of another convenience container device. At least one of the at least two convenience container devices may be stacked on another convenience container device. Furthermore, the kit may have a packaging material proximate to a portion of an outer surface of the at least two convenience container devices to protect the convenience container devices during transportation. In yet another aspect of the kit, the packaging material may comprise at least one heat shrinkable plastic to restrain the at least two convenience devices.

The foregoing and other objects, features, and advantages of the invention will be apparent from the following, more detailed description of the preferred embodiments of the invention, as illustrated in the accompanying drawings.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

Figure 1:
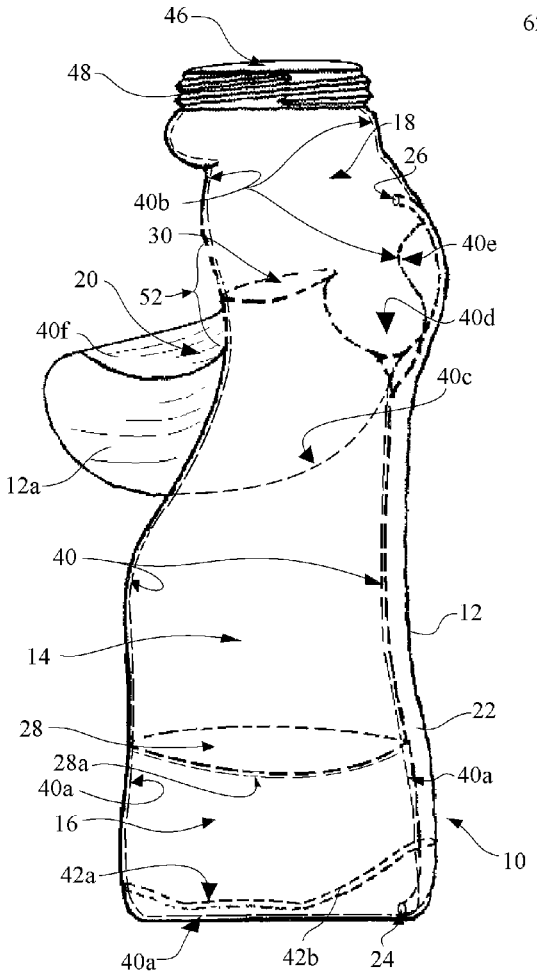
FIG. 1 is a side perspective view of a portion of a convenience container device comprising a food container in accordance with an exemplary embodiment of this invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention. Thus, the best mode embodiment of one feature may be shown in one drawing, and the best mode of another feature may be called out in another drawing. Unless otherwise noted, like character numbers shown in the figures refer to the same feature in each embodiment of the disclosure.

In the Summary above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link alternatives in a series of alternatives. The term "and/or" is used herein as a conjunction meaning that either or both of two options may be valid.

The term "and" is used herein as a conjunction to indicate an additional thing situation or fact.

When used in the appended claims the term "comprising at least one of A and B" as used herein (depending on the context of the specification) may mean: comprising either one of A or of B (and more), or comprising both of A and of B (and more). As is understood in the patent art, "comprising A" means "A and more", while "comprising B" means "B and more". Thus if A is excluded according to the context of the specification in the phrase "comprising at least one of A and B", then A cannot be part of the "and more" and similarly for B if B is excluded according to the context of the specification.

FIG. 1 is a side perspective view of a portion of a convenience container device 100 (see FIG. 3 and the description below) comprising a food container 10. As depicted in FIG. 1, the food container 10 includes an outer wall 12 enclosing an inner portion comprising one or more chambers. In one aspect of the disclosure the chambers may include a first chamber (or compartment) 14, a second chamber (or compartment) 16, a third chamber (or compartment) 18 and a fourth chamber (or compartment) 20. According to FIG. 1, the first chamber 14 may be defined by a portion of the outer wall 12 and a portion of an inner wall 40. Of course, a portion of the outer wall 12 and a portion of the inner wall 40 may comprise an outer surface of the food container 10 and an inner surface of the food container respectively. With reference to FIG. 1, as a matter of convenience in describing the function of each chamber, the outer wall 12 and the inner wall 40 are depicted and described herein separately. Without limiting the disclosure, a portion of the inner wall 40 may be adjacent to a tube (or capillary) 22 having a first opening 24 located at a first end of the tube and a second opening 26 located at a second end of the tube. As described below with reference to FIGS. 3A, 3B an upper portion of the tube 22 may be bifurcated. Furthermore, the first chamber 14 may be defined by a portion of a side of a first member (a separator wall) 28 located at an end of the first chamber and may have a first chamber opening (or outlet) 30 located at an opposite end of the first chamber. Although not shown in FIG. 1 (but see FIG. 3A, FIG. 3B and the description below), an outer portion of the first chamber 14 may include a first bifurcated (wall) member 32 and a second bifurcated (wall) member 34 to permit movement of a portion of a handle 36 of a spoon 38 (see FIG. 2A and the description below) between the bifurcated (wall) members of the first chamber adjacent to a surface of a portion of the fourth chamber 20. A portion of the surface of the fourth chamber 20 may be contiguous with a portion of the first chamber 14 (see FIG. 3A and the description below). In other words, the first chamber 14 may be configured with a bottom (28), sides 32, 34, 40 and an opening (or outlet) 30 wherein a bifurcated top portion of the first chamber is shaped so that the handle 36 and the spoon 38 may freely pass through the bifurcated top portion into the fourth chamber 20. The first chamber 14 may be configured to receive a free flowing solid food 80 such as cereal, noodles, rice, meat pieces and the like (see FIG. 3A and the description below).

Referring further to FIG. 1, the second chamber 16 may be defined by a portion of an inner wall 40*a* and a second chamber member 28*a*, which may be a portion of an opposite side of the first member (separator wall) 28. It will be appreciated that although FIG. 1 illustrates the second member 28*a* as being located on an opposite side of the first member 28 with a gap between the first member and the second member, there is no reason why the first member and the second member could not be configured with a single separator wall and with the first member comprising an inner surface of the first chamber 14 and the second member comprising an inner surface of the second chamber 16. A portion of the first end of the tube 22 having the opening 24 may be located in an interior portion of the second chamber 16 and may selectively receive a fluid (such as milk, broth and the like) that may be located in the second chamber (see FIG. 4A and the description below). A portion of the inner wall 40*a* may have an inwardly projecting surface 42*a*. From the point of view of the outer wall 12, a portion of the surface of the outer wall may have an indentation (or a hollow) 42*b*. In an aspect of the disclosure, the indentation 42*b* may be beneficially shaped to receive a portion of an outer surface of a lid assembly 50 (see FIG. 2 and the description below) of another convenience container device 100 so that one or more convenience container devices may be stacked efficiently (see FIG. 10 and the description below). Of course, the inner wall 40 of the first chamber 14 and the inner wall 40*a* of the second chamber 16 may comprise a contiguous inner wall of the food container 10.

Without limiting the disclosure, it is conceivable that the positioning of the first chamber 14 and the second chamber 16 may be interchanged. For example, in an aspect of the convenience container device 100, the first chamber 14 may be beside the second chamber 18. In another aspect, the positions of the first chamber and the second chamber may be reversed with the first chamber being below the second chamber. In yet another aspect, the first chamber 14 and the second chamber 16 may be configured so that the first chamber surrounds the second chamber or vice versa and have appropriate access conduits to the contents of each of the chambers (not shown, but refer to FIG. 1 for frame of reference information). Thus, the actual position of the first chamber 14 and the second chamber 18 located in an interior portion of the food container 10 may be substantially immaterial to the current disclosure.

Again with reference to FIG. 1, the third chamber 18 may be defined by a portion of a second inner wall 40*b*. A portion 40*c* of the second inner wall 40*b* may be substantially C-shaped to receive a portion of the spoon 38 and to permit free movement of the spoon within the third chamber 18. A portion (or mixing region) 40*d* of the second inner wall 40*b* may also be contoured appropriately (such as substantially U-shaped or concave as shown in FIG. 1) to selectively receive solid food 80 in a portion of the third chamber 18 from the first chamber 14 (see FIGS. 5-6 and the description below). Furthermore, a portion 40*e* of a surface of the outer wall 12 of the food container 10 adjacent to the third chamber 18 may be contoured (the portion 40*e* is shown in dotted lines as a substantially U-shaped concave portion of the outer wall of the food container). The portion 40*e* of the surface of the outer wall 12 may be sized to receive a portion of a trigger handle 54 (see FIG. 2 and the description below) when the trigger handle is engaged to dispense solid food 80 and fluid 82 using the spoon 38 (see FIG. 8 and the description below). A portion of the third chamber 18 may have a third chamber opening (or outlet) 46, configured to be accessible when receiving one or more solid foods 80 and/or one or more fluids 82 if the lid assembly 50 is decoupled from the food container 10 (see FIG. 9 and the description below). Furthermore, an outer portion of the third chamber 18 may comprise a male threaded region 48 sized to fit and couple to a female threaded region (not shown) of a portion of the lid assembly 50. Naturally, when so fitted, the third chamber opening 46 would be sealed to prevent loss of solid foods 80 and/or one or more fluids 82. The third chamber 18 may include a portion of the tube 22 and would be in selective fluid communication with the opening 26 located at the second end of the tube. One or more fluids 82 would conveniently drop into an inner portion of the third chamber and may drop into the U-shaped portion mixing region 40*d*. Moreover, as depicted in FIG. 1, the first chamber opening (or outlet) 20 may be located between the first chamber 14 and the third chamber 18 so that the solid food 80 may selectively flow freely between an interior portion of the first chamber and an inner portion of the third chamber. Thus, the third chamber 18 may be configured to temporarily receive both solid foods 80 and fluids 82 and may function as a mixing chamber or bowl (see FIGS. 5-7 and the description below) in the mixing region 40*d*.

Once again, without limiting the disclosure, it is understood that the positioning of the first chamber 14, the second chamber 16 and the third chamber 18 (relative to one another) may be altered as a matter of convenience, but the relative connections between each of these three chambers would be maintained.

Referring yet again to FIG. 1, a portion of the fourth chamber 20 may comprise a fourth chamber outer wall 12*a* that may be contiguous with the outer wall 12. Furthermore, the fourth chamber 20 may comprise a fourth chamber inner wall 40*f* defining a portion of a channel which may be contiguous with a portion of the inner wall 40. A portion of the outer wall 12 proximate to the fourth chamber 20 may have a fourth chamber opening (or food opening) 52 located between the third chamber 18 (not shown as clearly in FIG. 1, as compared to FIG. 3A). The fourth chamber opening (or food opening) 52 is sized to permit free movement of the spoon 38 from the third chamber 18 to the fourth chamber 20 and thus permit delivery of a mixture of solid foods 80 and fluids 82 to a user when the spoon is displaced from the third chamber to the fourth chamber through the food opening. As is readily apparent from FIG. 1, a portion of the fourth chamber 20 may have a lip (or beak) shape similar to a conventional bowl and therefore, may provide a "normal" eating experience for a user who "normally" prefers to eat cereal, soup or any other similar semi-fluid food with a spoon and bowl, but may be unable to do so because of unusual eating conditions. Such unusual eating conditions include for example, but are not limited to military situations for soldiers who cannot stop to have a regular meal, business people who have urgent appointments or for travelers who need to get a meal rapidly.

Figure 2:
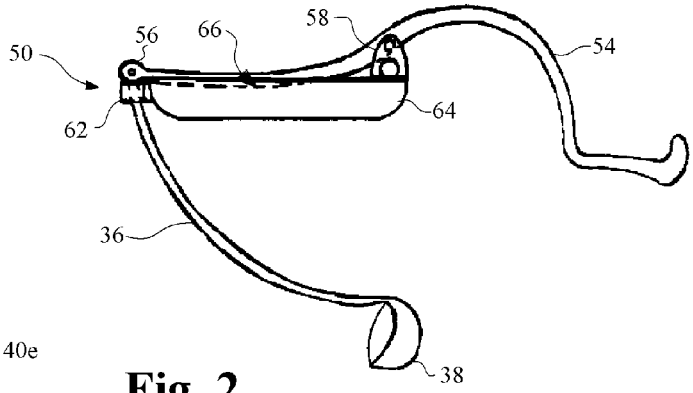
FIG. 2 is a side perspective view of a lid including a spoon comprising another portion of the convenience container device.
Figure 2A:
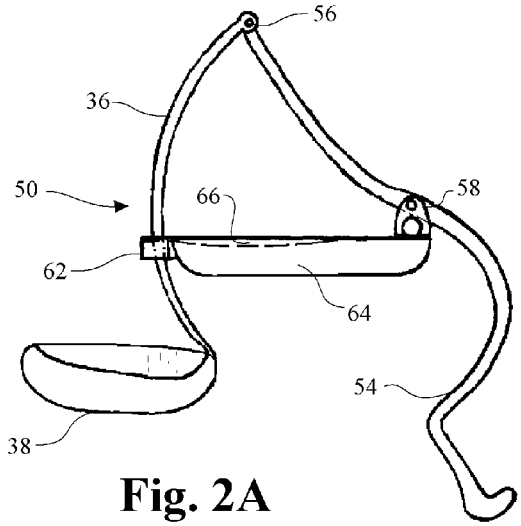
FIG. 2A is a side perspective view of the lid of FIG. 2 with the spoon in a different configuration.

FIG. 2 is a side perspective view of another portion of the convenience container device 100 comprising the lid assembly 50. The lid assembly 50 may comprise the handle 36 and the spoon 38 located at an end of the handle. An opposite end of the handle 36 may be pivotally coupled to the trigger handle 54. Further, the lid assembly 50 may include the lid 64 and may have a female thread (not shown) adapted to be coupled to the food container's male thread region 48 as described above. In an aspect, the lid assembly 50 may comprise a first pivot 56 (such as a spring loaded pin arrangement as is known in the art) coupled to both a portion of the opposite end of the handle 36 and to a portion of an end of the trigger handle 54 to facilitate pivotal maneuvering of the handle and the trigger handle about the first pivot. Similarly, the lid assembly 50 may comprise a second pivot 58 coupled to a portion (without limiting the disclosure, shown in FIG. 2 as being roughly in the center) of the trigger handle (or lever) 54 to permit pivotal maneuvering of the trigger handle about the second pivot. A portion of the second pivot 58 may be coupled to a portion of the lid 64. Further, a portion of a guide 62 (see FIGS. 3B, 4B, 5A and 8A for an alternative view of the guide) may be coupled to a portion of the lid 64. In an aspect the guide 62 may be substantially U-shaped or C-shaped. However, it is understood that these guide shapes are not necessary. With reference to FIGS. 2 and 2A, in an aspect of the disclosure, a portion of the handle 36 may freely slide between an inner portion of the guide 62 and an outer portion of the lid 64 to maintain relative stability of movement of the handle 36 and spoon (or ladle) 38. Of course, without limiting the disclosure, this is merely one configuration that may be suitable for synchronously moving an assembly of the spoon 38, handle 36 and trigger handle 54. In another aspect, although not shown in the Figures, it is understood that the handle 36 and the trigger handle 54 may be configured without the first pivot 56 or with one or more pivot and handle sections and with one or more guides 62 depending on the type of spoon movement that may be desired.

According to FIG. 2, the assembly of the spoon 38, handle 36 and trigger handle 54 are depicted as being in a substantially "rest" position. In contrast, FIG. 2A depicts the assembly of the spoon 38, the handle 36 and the trigger handle 54 in an "active" position such as when a user desires to move food from the third chamber 18 to the fourth chamber 20 (see FIGS. 5-8 and the description below). As shown in FIG. 2A, in one aspect of the disclosure, a portion of the lid 64 may have an indentation (or groove) 66 sized to receive a portion of the trigger handle 54. While this feature is not critical to operation of the spoon 38, the handle 36 and the trigger handle 54, it will be apparent that the indentation 66 may be a convenient feature to more efficiently stack a convenience container device 10 on top of another convenience container device (see FIG. 10 and the description below). Furthermore, comparison of FIG. 2 and FIG. 2A illustrates that without limiting the disclosure, the spoon 38 may have a variety of shapes. Of course, the geometric features of the first chamber 14, the third chamber 18 and the fourth chamber 20 may be modified as required to accommodate different spoon sizes and shapes.

Figure 3:
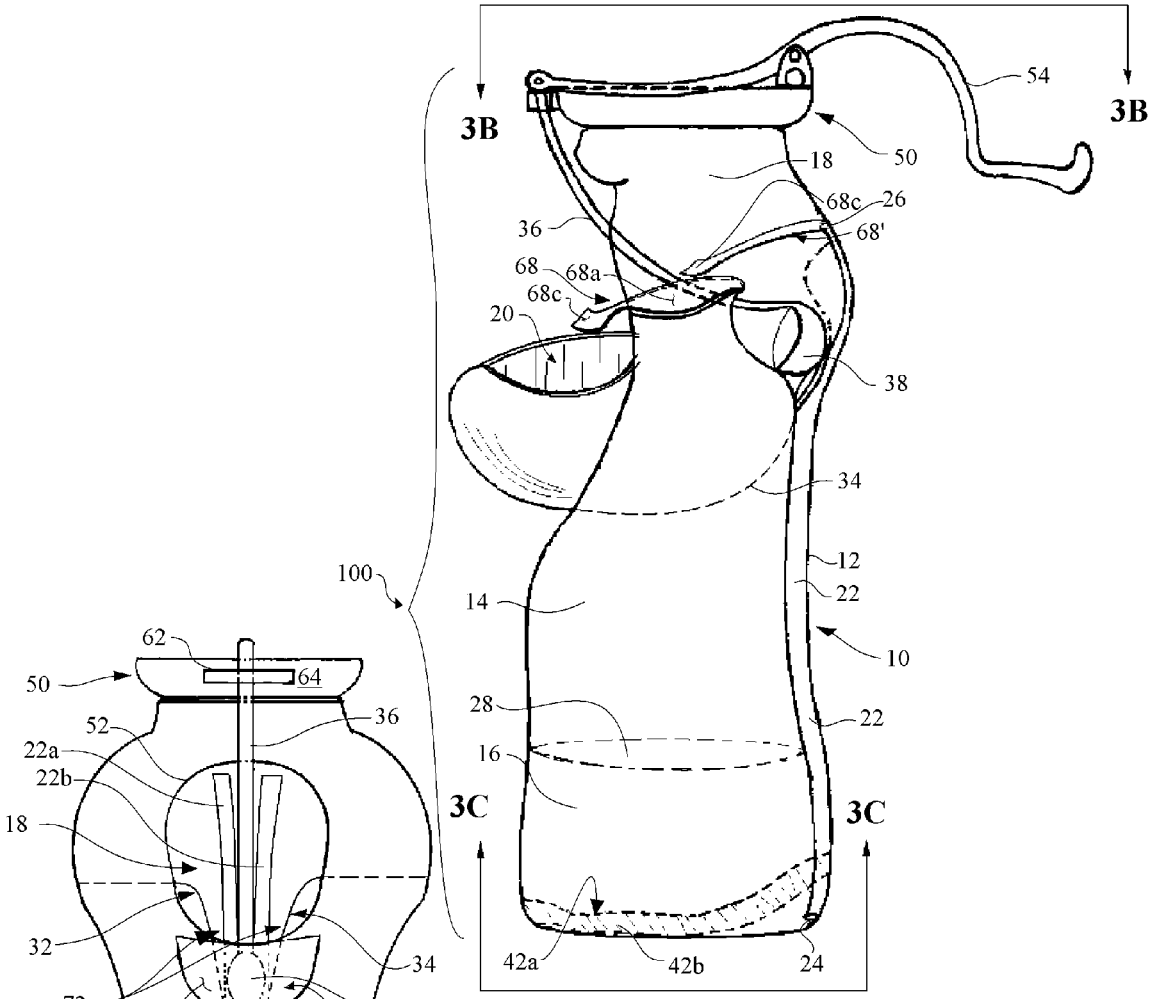
FIG. 3 is a side perspective view of the convenience container device with the lid of FIG. 2 coupled to the food container of FIG. 1.

Referring now to FIG. 3, in an embodiment of the convenience container device 100, the food container 10 is depicted as being selectively coupled to the lid assembly 50 as described above. In another aspect of the disclosure, the food container 10 may be permanently coupled to the lid assembly 50, as for example, when the convenience container device 100 is used on a one time only basis (i.e. as a disposable convenience container device) or the lid assembly and the food container may be an integrated structure with no visible demarcation between the lid assembly and the food container. FIG. 3 illustrates the same chamber and wall features as described above with respect to the food container 10 and the lid assembly 50 (see FIGS. 1, 2 and the description above). Specifically as depicted in FIG. 3, the convenience container device 100 may comprise one or more chambers located in an inner portion of the food container 10. The one or more chambers may comprise the first chamber 14, the tube 22 having a first end and a second end in selective fluid communication with an interior portion of the second chamber 16. Furthermore, the first chamber 14 may be in selective communication with the third chamber 18 and the fourth chamber 20 may be in selective communication with the third chamber. Thus, a portion of the handle 36 and the spoon 38 comprising a portion of the lid assembly 50 may be freely displaced from the third chamber 18 to the fourth chamber 20. As described above, the first chamber 14 may comprise one or more bifurcated members 32, 34 (a portion of the bifurcated member 34 is depicted in dotted lines in FIG. 3). It will be appreciated that as a matter of design, the first chamber 14 may be configured in different ways other than with the bifurcated members 32, 34 to permit the handle 36 and the spoon 38 to be moved (or swung, partially rotated, partially translated or displaced) from the third chamber 18 to the fourth chamber 20 when dispensing (or delivering) a food product to a user through the food opening 52. In an aspect of the disclosure it is conceivable that the bifurcated members 32, 34 may be designed as a single member located on a side of the first chamber 14 so that the handle 36 and the spoon 38 avoid contact with the first chamber as they move along a pre-determined path from the third chamber 18 to the fourth chamber 20 and vice versa. Of course, this single member would have the first chamber opening (or outlet) 30.

Referring again to FIG. 3, initially a rim portion of the first chamber opening (or outlet) 30 may be covered with a first removable sealant assembly (or first sealing member) 68 to prevent solid foods (not shown in FIG. 3, but shown in FIGS. 4-10) from flowing into the third chamber 18 from the first chamber 14 during transportation of the convenience container device 100. The first sealant assembly 68 may comprise a plastic coated foil or simply a plastic such as polyethylene or any other suitable substantially flexible material. In an aspect of the disclosure, a portion of an end 68*a* of the first sealant assembly 68 may be coupled to a rim portion of the first chamber opening 30 with one or more food safe adhesives such as pressure sensitive adhesives and the like or any other suitable adhesives. Alternatively, a portion of the end 68*a* of the first sealant 68 may be a heat sealed thermoplastic coupled to a portion of a rim of the first chamber opening 30 as is understood in the art. Similarly, initially a rim portion of the opening 26 located at the second end of the tube 22 may also be covered with a portion of an end 68*b* of a second removable sealant assembly 68' to prevent fluids (not shown in FIG. 3, but shown in FIGS. 4-10) from flowing into an interior portion of the third chamber 18 from an interior portion of the second chamber 16 during transportation of the convenience container device 100. Of course, the second sealant assembly 68' may comprise the same materials or different materials compared to the first sealant assembly 68 and may be either adhesively coupled or thermally sealed on a portion of a rim of the opening 26. An opposite end of each of the first and the second removable sealant assemblies 68 or 68' may comprise a portion designated as one or more tabs 68*c*. The tabs 68*c* may be accessed through the fourth chamber opening (food opening) 52 (see FIG. 3A) and conveniently pulled out by a user to lift (decouple) a portion of the end 68*a* of the one or more first sealants 68 off (from) the rim of the first chamber opening 30 to permit access to food solids hygienically pre-sealed and located in an interior portion of the first chamber 14. Similarly, tabs 68*c* located at the opposite end of the one or more second removable sealant assemblies 68' may be accessed through the fourth chamber opening (or food opening) 52 and a portion of the ends 68*b* of the second sealant assemblies 68' may be pulled off the rim of the opening 26 to permit access to fluids that were hygienically pre-sealed in the second chamber 16 (see FIGS. 4-10 and the description below). Of course, it is not necessary that the removable sealant assemblies comprise a separate first sealant assembly 68 and a separate second sealant assembly 68' (see FIG. 3D and FIG. 3E and the description below).

Figure 3A:
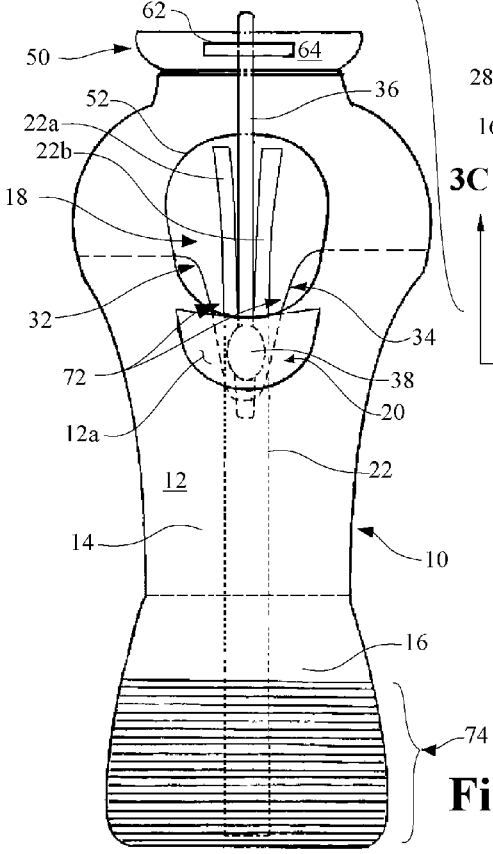
FIG. 3A is a front perspective view of the convenience container device of FIG. 3.

FIG. 3A is a front perspective view of the convenience container device 100 shown in FIG. 3. According to FIG. 3A, a portion of the first bifurcated member 32 and a portion of the second bifurcated member 34 define a passageway (or channel) 72 which permits the handle 36 and the spoon 38 to freely pass from an interior portion of the third chamber 18 to an interior portion such as 40*f* (see FIG. 1) of the fourth chamber 20. Furthermore, the second end of an upper portion of the tube 22 may comprise a first bifurcated tube portion 22*a* and a second bifurcated tube portion 22*b*. Since the third chamber 18 has a U-shaped concave portion 40*e* configured to receive a portion of the trigger handle 54 (see description above), a substantially convex shaped back portion of the inner wall 40*b* of the third chamber may protrude into the third chamber. As illustrated in FIG. 3A, each bifurcated tube portion 22*a* and 22*b* may lie on either side of a back portion of the inner wall 40*b*. The bifurcated tube portions 22*a* and 22*b* eventually join and merge to become the tube 22 and thus the tube may a Y-shaped appearance. It will be appreciated that this is but one possible design for an upper portion of the tube 22. For example, in another aspect, the tube 22 may not be bifurcated and may be simply mounted to one or the other side of a back portion of the inner wall 40*b*. Additionally the tube 22 may comprise a contoured portion of any inner wall 40 with the second end having the opening 26 conveniently configured (arched or in any other suitable manner) to deliver fluids into the third chamber 18 so that partial mixing of the food solids and the fluids may occur. Of course, in yet another aspect of the disclosure, a portion of the tube 22 may be located on a portion of the outer wall 12 of the food container 10.

Referring again to FIG. 3A, an outer portion of the fourth chamber 20 is shown having a beak shape or a bowl shape and has an inner channel. The inner channel may be defined by the outer wall 12*a* and the outer wall 12 and generally further defined by the inner portion 40*f* (see FIG. 1 and the description above) with a portion of the channel of the fourth chamber communicating with the third chamber 18 through the fourth chamber opening (food opening) 52. As described above, the beak or bowl shaped fourth chamber 20 may receive a food mixture of solid foods and fluids from an inner portion of the third chamber 18. When the spoon 38 delivers a portion of the solid foods and fluids to the user (thus functioning as a temporary bowl of say cereal and milk) the fourth chamber 20 may provide a more "normal" eating experience with the convenience container device 100 since the spoon may be loaded with the food mixture that is in the fourth chamber rather than being retracted back into the third chamber 18.

FIG. 3A also shows a front view of the guide 62 with a portion of the handle 36 passing between an inner surface of the guide and an outer surface of the lid 64. Furthermore, a lower outer portion of the food container 10 may comprise a corrugated (or ridged or grooved) region 74. In an exemplary embodiment the food container 10 may comprise one or more plastic polymers such as polyethylene, polyester, copolymers of various kinds, and/or the like. The plastic polymers may be suitably flexible and ductile to withstand ordinary handling during shipping and restocking of the convenience container device 100. The corrugated region 74 may provide a better gripping surface. Further, the corrugated region 74 may designate where a user could squeeze or otherwise engage the outer wall 12 to create internal pressure to deliver or force food fluids from an interior portion of the second chamber 16 to an interior portion of the third chamber 18 of the convenience container device 100. Of course, this is but one method of delivering food fluids from the second chamber 16 to the third chamber 18. In other aspects of the disclosure it is conceivable that other mechanical devices now known or that may be disclosed in the future may be used to create pressure.

Figure 3B:
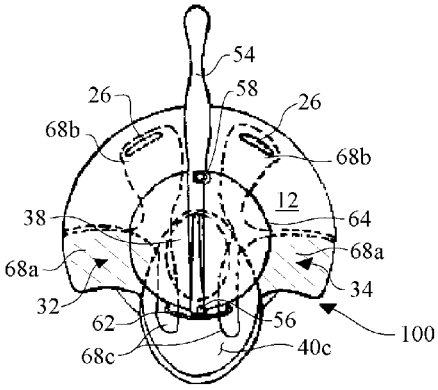
FIG. 3B is a top plan view along the line 3B-3B of the convenience container device of FIG. 3.

FIG. 3B depicts a top plan view along the line 3B-3B of the convenience container device 100. Referring to FIG. 3B, the fourth chamber 20 may be defined by a portion of the surface of the inner wall 40*c* and an interior portion of the fourth chamber may be contiguous with or adjacent to an inner portion the third chamber 18. Furthermore the tabs 68*c* may protrude from the third chamber and an end 68*a* of each removable sealant assembly 68 may couple to a portion of the rims (not labeled, but clearly visible in FIGS. 1, 3-3A) of each of the first chamber openings 30 of each bifurcated members 32, 34 of the first chamber 14. Additionally, an end 68*b* of each removable sealant assembly 68' may couple to a portion of the rims (not labeled, but clearly visible in FIGS. 1, 3-3A) of each of the openings 26 of each bifurcated portion 22*a*, 22*b* of the tube 22. FIG. 3B also depicts the lid 64 including the guide 64 coupled to an outer portion of the lid, the first pivot 56 located on a portion of the lid and the second pivot 58 located on a portion of the lid. An end of the trigger handle 54 may be coupled to the first pivot 56 and another portion of the trigger handle (roughly located in the center of the trigger handle) may be coupled to the second pivot 58. Furthermore, without limiting the disclosure, an upper portion of the outer wall 12 of the food container 10 may protrude outwardly from a central axis (not shown) of the convenience food container device 100. As expected, the shape of the upper portion of the outer wall 12 is not critical to the function of the convenience food container device 100. FIG. 3C depicts a bottom plan view along the line 3C-3C of the convenience container device 100. As described above, a portion of the outer wall 12 of the food container 10 may have the indentation 42*b* configured to receive a portion of the lid assembly 50 of another convenience container device 100 (see FIG. 10 and the description below).

FIG. 3C depicts an underside view of the trigger handle 54, an underside view of an outer portion 12*a* of the fourth chamber (beak) 20 as well as the opening 24 at an end of the tube 22. Of course, it is understood that the food container 12 may comprise any type of material including but not limited to a clear or translucent plastic, which would make it possible to visually see at least some aspects of the interior of the food container as described herein. Naturally, where dotted lines have been used in the drawings described herein, the dotted lines may represent, unless otherwise noted, optically visible features of the convenience container device 100 that do not require that the device be dissected or otherwise destructively analyzed.

Figure 3D:
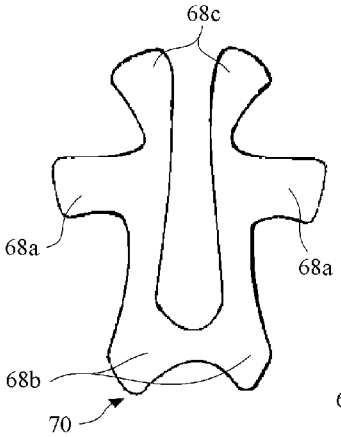
FIG. 3D and FIG. 3E are alternative embodiments of removable sealant assemblies for a portion of the convenience container device of FIG. 3.
Figure 3E:
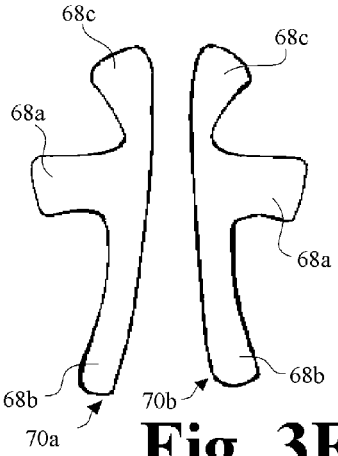
Figure 3C:
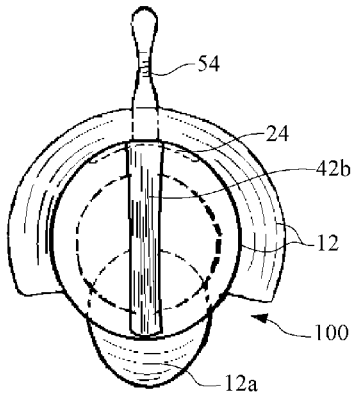
FIG. 3C is a bottom plan view along the line 3C-3C of the convenience container device of FIG. 3.

Turning now to FIG. 3D and FIG. 3E, without limiting the disclosure, several exemplary embodiments of removable sealants (or sealant assemblies) 70, 70*a*, 70*b* that may be used in the convenience container device 100 are depicted as a unitary member (FIG. 3D) or alternatively as a right handed member 70*a* and a left handed member 70*b* (FIG. 3E). Naturally, these are simply illustrative of possible sealant assemblies. With reference to FIG. 3D, in an aspect of the disclosure, a removable sealant assembly 70 having tabs 68*c* located at a first end and a second end of the removable sealant assembly 68 includes one or more first sealant ends 68*a* and one or more second sealant ends 68*b*. The first sealant ends 68*a* may be initially coupled to a portion of the rims of the first chamber's openings (outlets) 30 for each bifurcated member 32, 34 as described above (see FIG. 3B). The second sealant ends 68*b* may be initially coupled to a portion of the rims of the openings 26 of the tube 22 as described above (see FIG. 3B). Each of the first sealant ends 68*a* and the second sealant ends 68*b* may project from a portion of the removable sealant assembly 68. Alternatively, in an another embodiment, as shown in FIG. 3E, the removable sealant assemblies 70*a* or 70*b* may comprise a first sealant end 68*a* projecting from a portion of either of the removable sealant assemblies and a second sealant end 68*b* projecting from a portion of either of the removable sealant assemblies with a tab 68*c* at an opposite end of either of the removable sealant assemblies. In this alternative embodiment one of the removable sealant assemblies 70*a* or 70*b* may be a mirror image of the other. Of course, in each embodiment the tabs 68*c* may be accessible through the fourth chamber opening (food opening) 52 to be manipulated and to permit at least a portion of either of the sealant assemblies 70*a* or 70*b* to be selectively decoupled from a portion of the rims of the openings 26 and from a portion of the rims of the first chamber's openings (outlets) 30 for each bifurcated member 32 and 34.

Methods of Operating the Convenience Container Devices

FIGS. 4-9 depict one or more method steps that may occur when the convenience container device 100 is used in a substantially one-handed operation to dispense food products. Of course, the method steps may vary from those disclosed herein in some degree, but it will be understood that such variations are within the scope of the current disclosure.

Figure 4A:
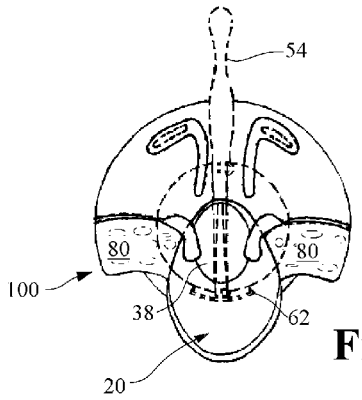
FIG. 4A is a top plan view along the line 4A-4A of the convenience container device of FIG. 4.
Figure 4:
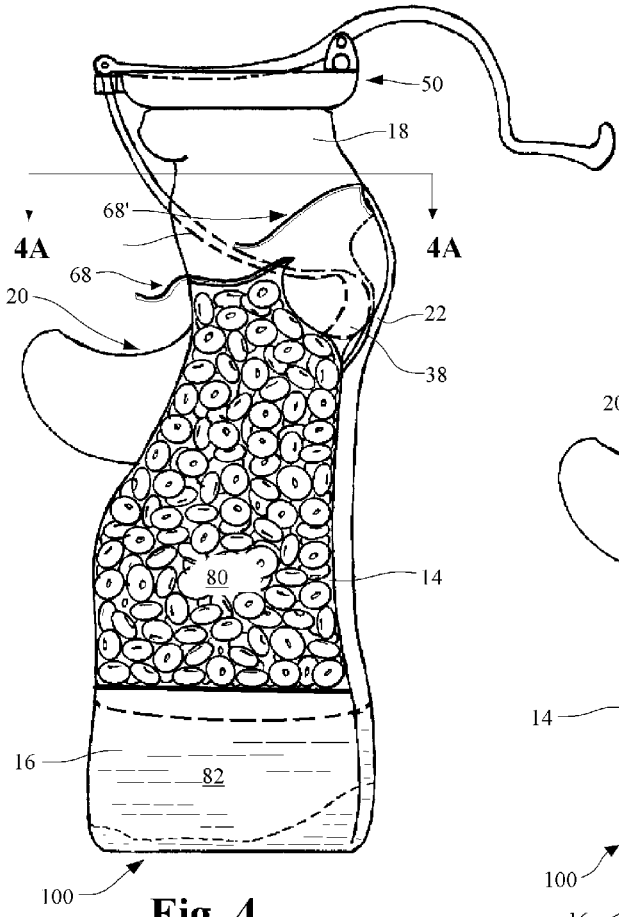
FIG. 4 is a side view of the convenience container device of FIG. 3 including a solid and a fluid in separate compartments (or chambers) within the convenience container device and configured with at least one of the sealant assemblies of FIG. 3D or FIG. 3E according to an exemplary embodiment of this invention.

FIG. 4 is a side view of the convenience container device 100 including one or more solid foods 80 located in an interior portion of the chamber 14 and one or more fluids 82 located in an interior portion of the chamber 16. Without limiting the disclosure, and merely for illustrative purposes, the solid food 80 may comprise cereal (as depicted herein) and the fluid 82 may comprise milk (as depicted herein). Initially, the convenience container device 100 may contain no cereal or milk as depicted in FIG. 3. Additionally, of course, neither of the sealant assemblies would be coupled to the first chamber's openings (outlets) 30 and the tube's openings 26 as described above with reference to FIG. 3. Furthermore, initially the lid assembly 50 would be decoupled from the food container 10.

Thus, in a step S1 of a method of loading the food container 10, the solid food (hereinafter, cereal) may be dispensed into an interior potion of the first chamber 14 through the food container's opening (either inlet or outlet) 40 (see discussion with reference to FIG. 1 above and FIG. 9 below). Furthermore, in yet another step S2, the fluid 82 (hereinafter, milk) may dispensed with application of pressure as is understood in the art into an interior portion of the second chamber 16 through the food container's opening 40 through the tube's 22 opening 26. Of course step S2 may be accomplished in other ways, such as in one example which may be by providing one or more access holes (not shown) in a portion of the outer wall 12 proximate to the second chamber 16 and dispensing milk into an interior portion of the second chamber followed by sealing the access holes when sufficient milk has been dispensed. In yet another step S3, at least one of the sealant assemblies 68, 68', 70, 70*a* or 70*b* may be placed over the respective rims of each of the openings 26 and 30 (described above) and may be adhesively or thermally coupled to the openings to seal in the cereal and the milk. Additionally, in another optional step S4, yet another sealant assembly (not shown) may be coupled to a portion of a rim of the fourth chamber opening (food opening) 52 (see FIG. 3A) to provide yet another security feature for a consumer that would assure the consumer that the convenience container device 100 had not be opened prior to purchase. Thus the interior of an opaque version of the food container 10 would not be visible to a consumer unless at least a portion of the another sealant assembly (not shown) had been pulled off or otherwise removed.

In another step S5, the lid assembly 50 may be coupled to the food container 10. In order to accomplish step S5, the spoon 38 and handle 36 may initially be decoupled from the first pivot 56 and the lid assembly 50 may be screwed onto the male threaded region 48 (see FIG. 1). Then the spoon 38 and handle 36 may be inserted through the food opening 52 into the third chamber 18 and an opposite end of the handle may be inserted through the guide 62 and thereafter coupled to an end of the trigger handle 54. Thus, when step S5 is accomplished in this manner, the optional step S4 would precede Step S5. In an alternative of Step S5 as described above, the entire lid assembly 50 may be coupled directly to a portion of a rim of the third chamber opening (outlet) 46 by for example, and without limiting the disclosure, snapping (or pressing on) the lid assembly onto the food container's third chamber opening or by thermally sealing the lid assembly to a portion of the food container's third chamber opening as would be understood in the art. Naturally, optional step S4 could then precede step S5.

FIG. 4A shows a sectional view through 4A-4A of FIG. 4 prior to pulling on the tabs 68*c* and illustrates the location of the cereal in an interior portion of the first chamber 14. It should be noted that in FIG. 4A, 5A-7A, portions of the lid assembly 50 are shown in dotted lines to illustrate positioning of components of the lid assembly relative to the food container 10 during the method steps.

Figure 4B:
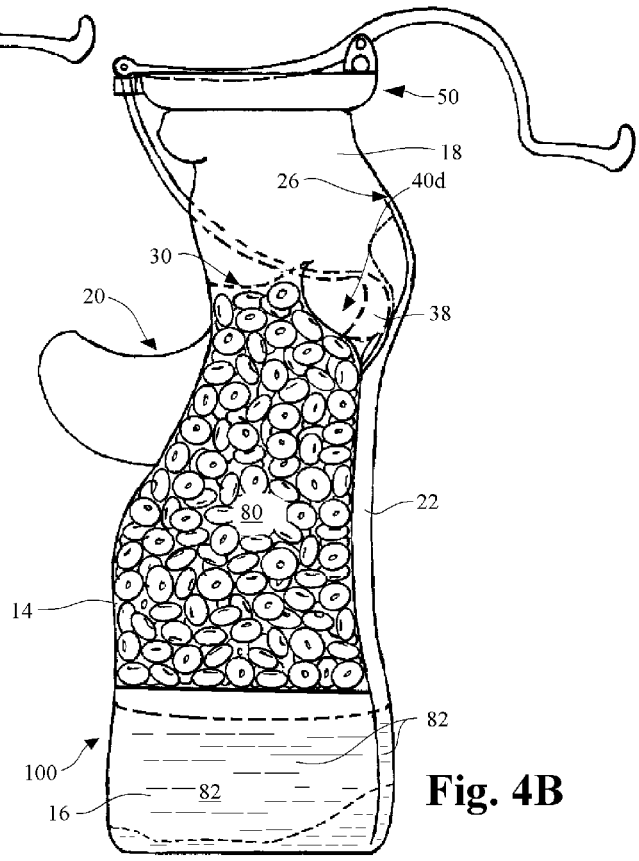
FIG. 4B is a side view of the convenience container device of FIG. 4 configured without the sealant assemblies of either FIG. 3D or FIG. 3E.

FIG. 4B shows a result of an initial step S10 of a method of using the convenience container device 100 in a one-handed feeding operation. During the initial step S10, the sealant assemblies 68, 68', 70, 70*a* or 70*b* may be grabbed and peeled or pulled off with the one or more tags 68*c* as described above with reference to FIG. 3 in order to expose the cereal 80 and the milk 82 in preparation for further steps, which facilitate the one-handed feeding operation. Consequently, the first chamber's 14 opening (outlet) 30 and the tube's 22 second opening 26 may now be accessible. Furthermore, as illustrated in FIG. 4B, the spoon 38 may remain in a rest position located in the third chamber's 18 U-shaped portion (mixing region) 40*d* and the trigger handle 54 may remain in an unarmed (or raised or inactive) position and in dependent relationship to the positioning of the spoon.

Figure 5:
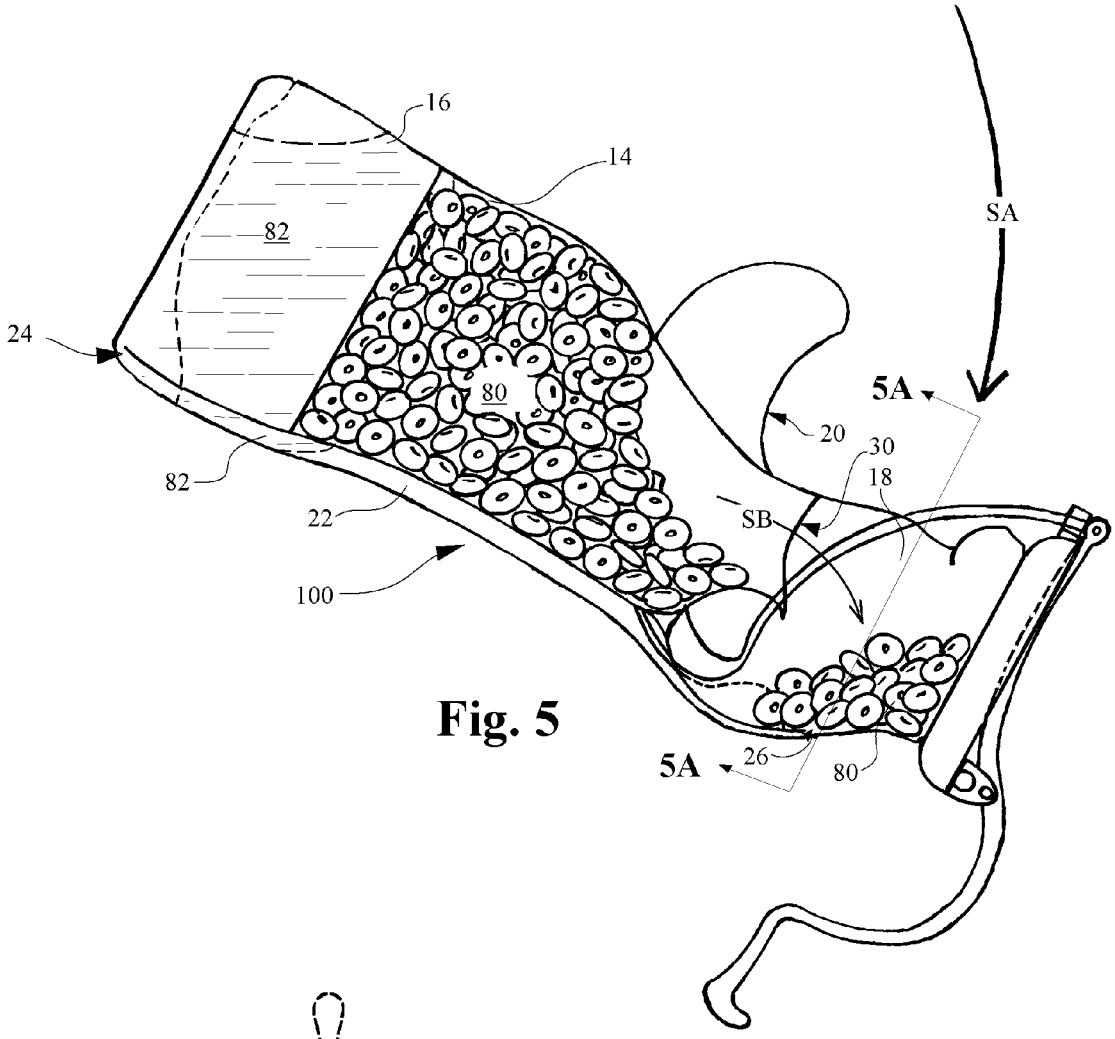
FIG. 5 is a side view of the convenience container device of FIG. 4B in a tilted position.
Figure 5A:
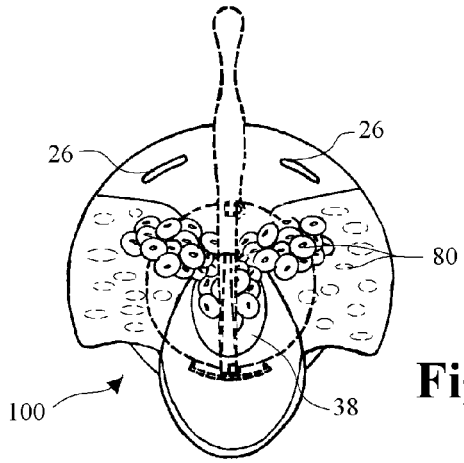
FIG. 5A is a top plan view along the line 5A-5A of the convenience container device of FIG. 5 in a tilted position.

In a further step S11 of this method of one-handed feeding, as illustrated by the clockwise arrow SA in FIG. 5, the convenience container device 100 may be tilted (or rotated) so that cereal 80 could be dispensed from an inner portion of the first chamber 14 through the opening (outlet) 30 into an inner portion of the third chamber 18 (see clockwise arrow SB). Of course, the tilting operation may result in more than a single serving of cereal 80 being fed (or dispensed) into the interior of the third chamber 18. For reference, FIG. 5A depicts a sectional view through the line 5A-5A of FIG. 5. As illustrated in FIG. 5A, during this step 11, cereal 80 may principally land in an inner portion of the third chamber 18, but a portion of the cereal 80 may also land on a portion of the spoon 38. It should be noted that when this is the first time that the convenience container device 100 is tilted using this method step 11, the third chamber 18 remains dry. In other words, the milk 82 has not yet been delivered into the interior of the third chamber 18.

Figure 6A:
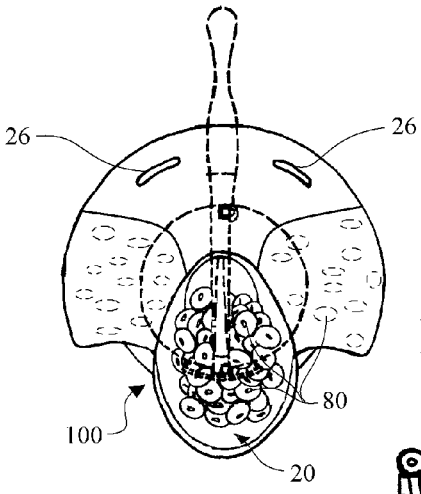
FIG. 6A is a top plan view along the line 6A-6A of the convenience container device of FIG. 6 after the convenience container device is returned from the tilted position to an upright position.
Figure 6:
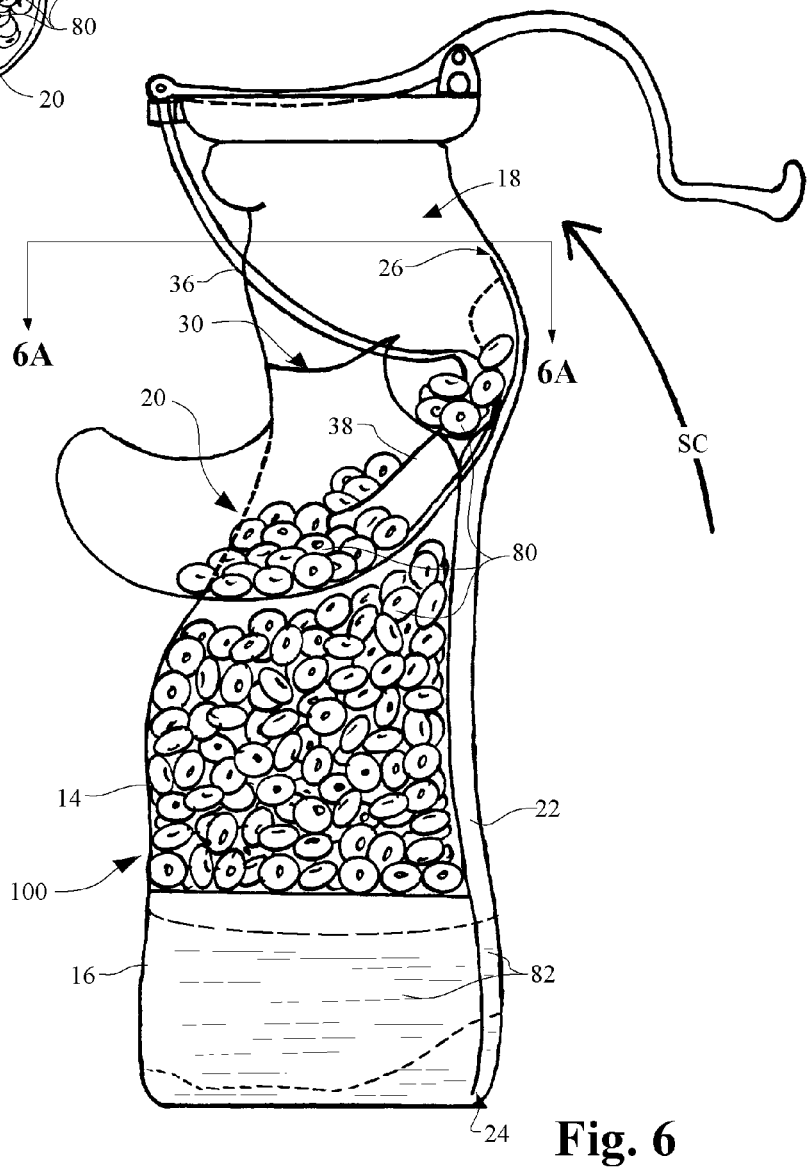
FIG. 6 is a side view of the convenience container device of FIG. 4B after the convenience container device is returned from the tilted position to an upright position.

Referring now to FIG. 6 in another step S12 of the method for one-handed feeding, the convenience container device 100 may be rotated anti-clockwise (see arrow SC) and the cereal 80 currently in the interior of the third chamber 18 may fall (or be dispensed) into an inner portion such as 40*f* (see FIG. 1) of the fourth chamber (or bowl) 20. It should be noted again that initially the interior of the third chamber 18 still remains substantially dry since once again no milk 82 has been dispensed as yet from an inner portion of the second chamber 16. For reference, FIG. 6A depicts a sectional view through the line 6A-6A of FIG. 6. In FIG. 6A, it may be seen that a portion of the cereal 80 may now be located on the spoon 38, on the portion 40*f* (see FIG. 1) in the fourth chamber (bowl) 20 and of course, also in an inner portion of the third chamber 18 as well as in an inner portion of the first chamber 14. While some users may conceivably like to eat dry cereal, the following steps illustrate how a user may receive a mixture of milk and cereal. It is understood though that if a user wishes to eat dry cereal 80 using the one-handed method described so far, this may be accomplished simply by activating (or pressing on) the trigger handle 54 as will be described below with reference to FIG. 8.

Figure 7A:
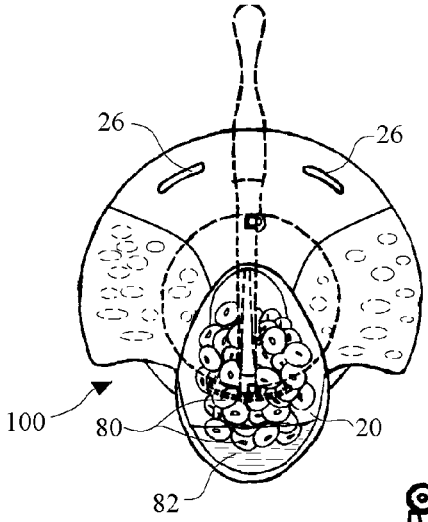
FIG. 7A is a top plan view of the convenience container device of FIG. 7 after a portion of fluid has been dispensed from the lower portion of the convenience container to the upper portion of the convenience container.
Figure 7:
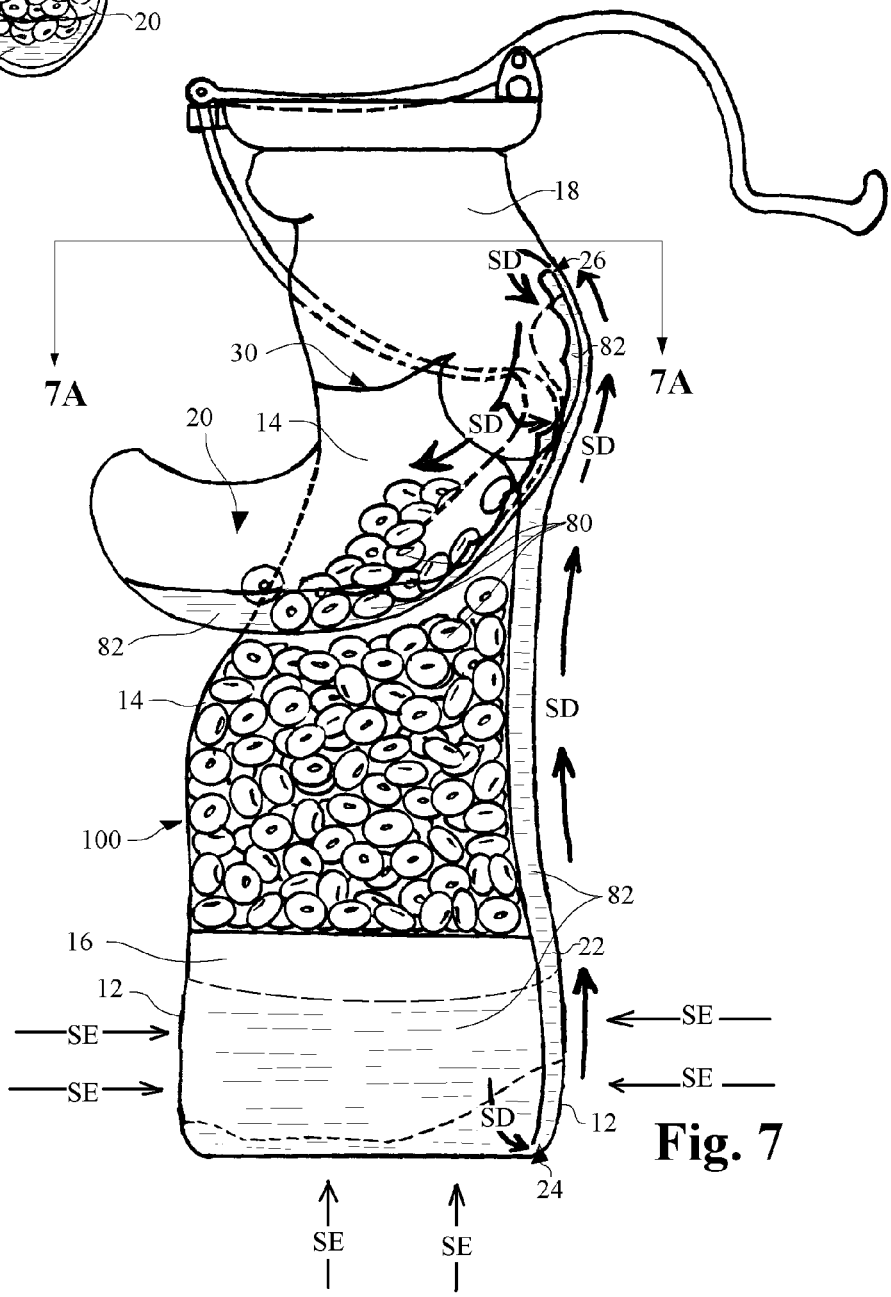
FIG. 7 is a side view of the convenience container device of FIG. 6 after a portion of fluid has been dispensed from a lower portion of the convenience container to an upper portion of the convenience container.

FIG. 7 illustrates the actions and results that may occur in a step S13 of the method for one-handed feeding. As depicted in FIG. 7, milk 82 may be dispensed from an inner portion of the second chamber 16 through the first end opening 24 of the tube 22 and out of the second end opening 26 of the tube into an inner portion of the third chamber 18 as well as into the portion 40*f* of the fourth chamber 20 along the path shown by the arrows SD. Without limiting the disclosure, step S13 may be accomplished in a number of ways. The following describes but one embodiment of a method of delivering milk 82 from an inner portion of the second chamber 16 to an inner portion of the third chamber 18 and into an inner portion such as the portion 40*f* of the fourth chamber 20. In an exemplary method, dispensing of milk in step S13 occurs when a user squeezes (or applies hand pressure) in a substantially perpendicular direction to a tangential surface of a portion of the outer wall 12 of the food container 10 as shown by arrows SE. Of course, unlike shown in FIG. 7, the squeezing may occur on a higher portion of the outer wall 12. The applied hand pressure may force milk up the tube 22 as is understood in the art and may take advantage of capillary movement up the tube 22. Although not illustrated in FIG. 7, it is conceivable that a portion of the outer wall 12 may further comprise a plunger configured to increase the internal pressure in the second chamber 16 and thereby drive milk 82 up the tube 22 into an inner portion of the third chamber 18 and an inner portion of the fourth chamber 20. Of course, in an alternative embodiment, this application of internal pressure may be actuated by pump action (not shown) after a user activates an external button (not shown) to provide hydraulic pressure as is understood in the art.

It should be noted that in step S13, the milk 82 will not fall into an inner portion of the first chamber 14 which comprises dry cereal because of the specific shape design features between one or more adjacent features (walls) of the first chamber and the third chamber 18. Thus, the opening (outlet) 30 of a top outer section of the first chamber 14 may be elevated relative to the third chamber's 18 inner U-shaped portion (mixing region) 40*d* and the fourth chamber 20 (as discussed earlier with reference to FIG. 3 above and shown in FIGS. 1 and 3-10). For reference, FIG. 7A depicts a sectional view through the line 7A-7A of FIG. 7. In FIG. 7A, it may be seen that a portion of the cereal 80 may now be located on the spoon 38, in an inner portion (bowl) of the fourth chamber 20 and of course, also in an inner portion of the third chamber 18 as well as in an inner portion of the first chamber 14. Furthermore, milk 82 may also mix with the cereal 80 because the cereal may also be located on the spoon 38, in the bowl of the fourth chamber 20 and of course, also in an inner portion of the third chamber 18, but not in an inner portion of the first chamber 14.

Figure 8A:
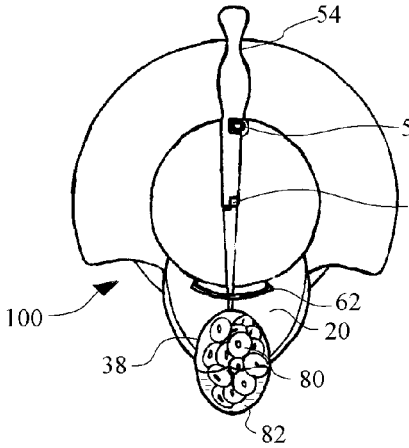
FIG. 8A is a top plan view of the convenience container device of FIG. 7 after lifting a mixture of the solid food and the fluid with the spoon from the inner portion of the convenience container device.
Figure 8:
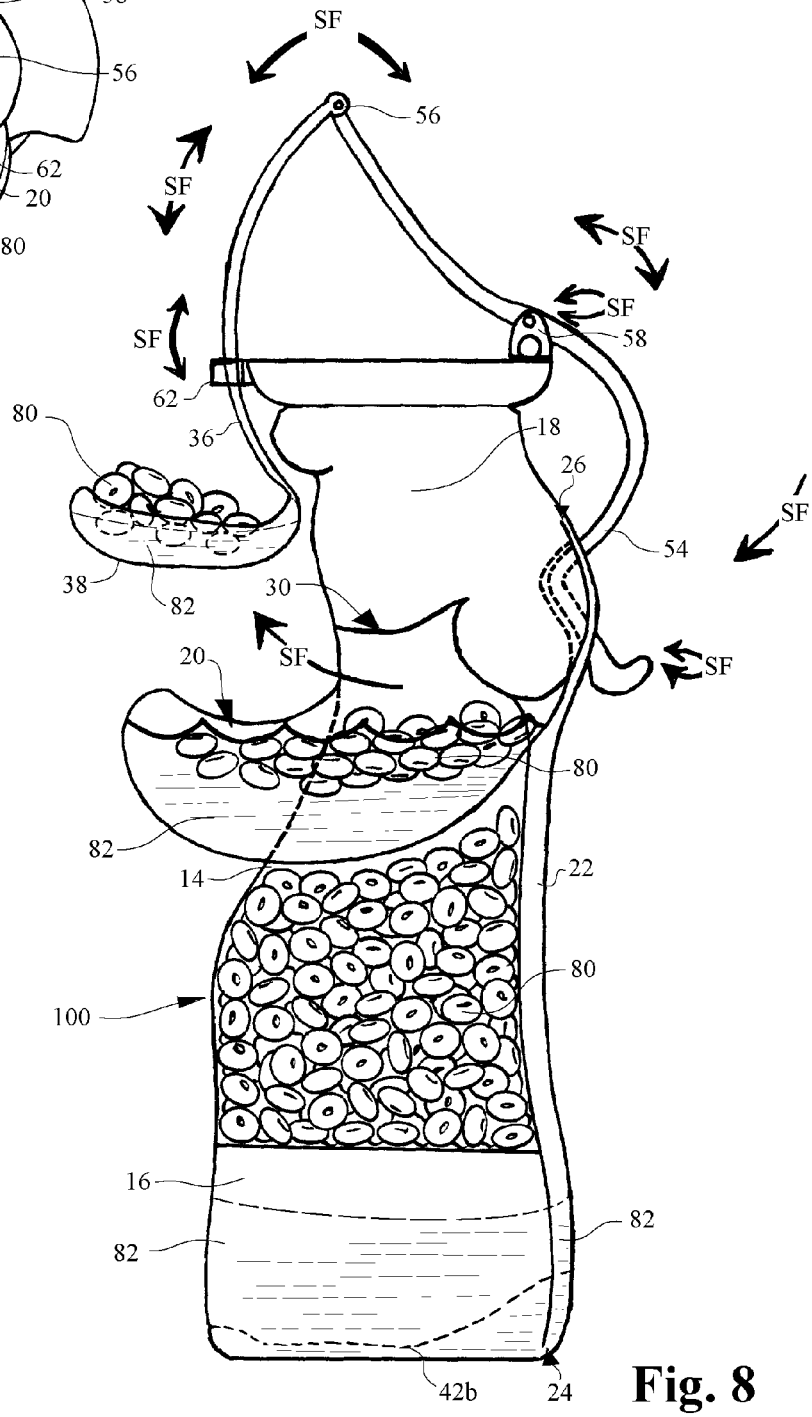
FIG. 8 is a side view of the convenience container device of FIG. 7 after lifting a mixture of a solid food and a fluid with the spoon from an inner portion of the convenience container device.

FIG. 8 illustrates the actions and results of step S14. In step S14, the spoon 38 may have been loaded with both milk 82 and cereal 80 and may now be displaced from the third chamber's 18 U-shaped inner portion mixing region 40*d* to the fourth chamber's 20 bowl and then out of the fourth chamber's bowl as indicated by arrows SF. Specifically, with reference to FIG. 8, in a first round of a feeding cycle, a user would press on the trigger handle 54, which would then cause a rotational motion about an axis of the second pivot 58. This rotational motion about the axis of the second pivot 58 would result in a rotation about an axis of the first pivot 56 and consequently result in an upward translational of the handle 36 and the spoon 38 through the guide 62. Thus the spoon 38 including cereal 80 and milk 82 would be lifted out of an inner portion of the third chamber 18 and of the fourth chamber 20 as expected and conveniently feed the user in a one-handed operation which would mimic "normal" eating patterns. In a step S15 (not shown), once the cereal 80 and milk 82 were consumed, a user would release pressure on (or disengage from) the trigger handle 54, and the reverse rotations and translations would displace the spoon 38 back into the inner portion (bowl) 40*f* (see FIG. 1) of the fourth chamber 20 and possibly back into an inner portion of the third chamber 18 if the user's hand completely releases applied pressure on the trigger handle. Otherwise, if the user only partially released pressure on the trigger handle 54, the spoon 38 may pick up another serving of cereal 80 and milk 82 from the fourth chamber's 20 bowl, and re-apply pressure on the trigger handle to lift the spoon including cereal 80 and milk 82 out of the fourth chamber's bowl in yet another feeding cycle.

Naturally, once all cereal 80 and milk 82 that was available in inner portions of the third chamber 18 and the fourth chamber 20 was consumed, steps S11-S15 may be repeated until all the cereal located in an inner portion (or interior) of the first chamber 14 and the milk located in an inner portion (or interior) of the second chamber 16 was consumed. Subsequently, if the convenience container device 100 was configured to be recyclable, the convenience container device may be refilled with cereal 80 and milk 82, or otherwise the convenience container device may be disposed. In an embodiment, the disposable convenience container device 100 could comprise environmentally friendly plastics that degraded in the environment to harmless and possibly useful constituents such as lactic acid. In other words in one non-limiting aspect of the disclosure, the plastics may be lactic acid based polymers or any biodegradable plastics as is known in the art.

Figure 9:
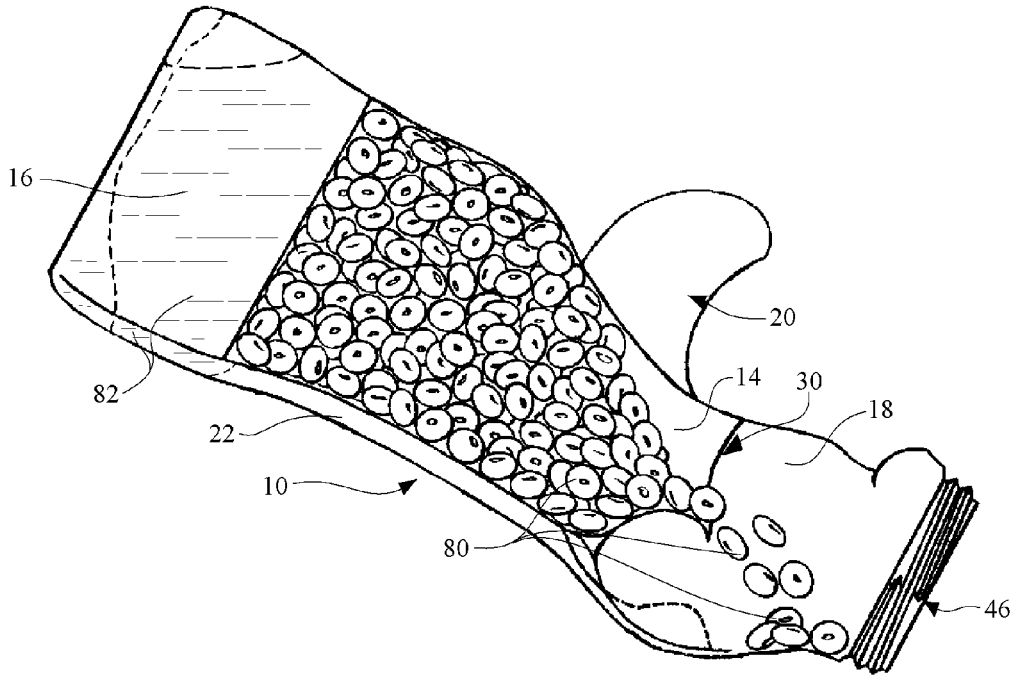
FIG. 9 is a side view of the food container of FIG. 1 including a solid food and a fluid and with the food container in a tilted position.

FIG. 9 illustrates an embodiment of the convenience container device 100 in which the lid assembly 50 may be conveniently separated from the food container 10 and tilted to permit cereal 80 to flow from an inner portion of the first chamber 14 into an inner part of the third chamber 18 and thereafter out of the third chamber through the third chamber opening (outlet) 46. In this manner a user may receive dry cereal 80 if desired. Of course, as noted above, the solid product 80 may be any food. It should be noted that unless the user specifically applied sufficient pressure to the food container 10, the milk 82 would not flow from the second chamber 16 through the tube 22 and out of the tube's second end opening 26 because of capillary forces and surface tension on the milk proximate to the first end opening 24 of the tube 22.

Figure 10:
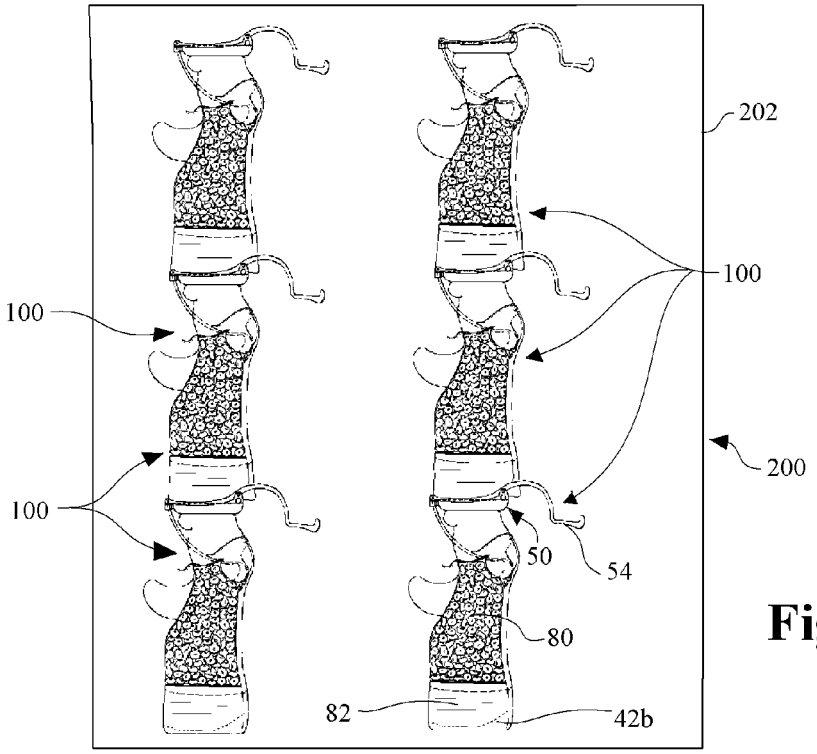
FIG. 10 is a side view of a kit comprising a plurality of the convenience container devices of FIG. 3 stacked in a package according to an exemplary embodiment of this invention.

FIG. 10 depicts an exemplary embodiment of a side view of a kit 200 comprising a plurality of convenience container devices 100 stacked in a package 202. As described briefly above, a portion of the second chamber 16 of each of the convenience container devices 100 has an indentation 42*b*. Referring to FIG. 10, the indentation 42*b* of a first convenience container device 100 may receive a portion of the trigger handle 54 of a second convenience container device 100, while the second convenience container device may have yet another indentation located in a portion of the second chamber 16 and may receive a third convenience container device 100 stacked thereon and so on. Furthermore, of course without limiting the disclosure, yet one or more other stacks of convenience container devices 100 may be located in the package 202 of the kit 202. In one aspect, without limiting the disclosure, the package 202 may comprise any convenient material including polyethylene and the like, which may be heat shrunk around the convenience container devices 100 to retain the devices in position during transportation. The kit 200 may thus be conveniently distributed from one or more central manufacturing or wholesale locations to other wholesale and retail locations as desired with minimal destruction of any of the convenience consumer devices 100. Furthermore, if the convenience consumer devices 100 are recyclable, stacks of the convenience consumer devices may be stored and wrapped or otherwise confined for shipping back to a refilling or recycling site.

In another aspect of the disclosure, a kit 200 may simply comprise one or more lid assemblies 50 (as described above) or one or more food containers 10 (as described above), each being within a package. Furthermore, the kit may alternatively comprise one or more food containers 10 and one or more lid assemblies 50. In yet another aspect of the disclosure, a kit 200 may further include at least one of the following: one or more packages of food solids and one or more food fluids. Such kits 200 may be used as a portion of a manufacturing cycle of convenience container devices 100 or in a distribution chain to various manufacturing sites. Of course, such kits 200 may be used during distribution from one or more manufacturing sites to one or more wholesalers and from one or more wholesaler to another one or more wholesaler, or from one or more wholesaler to one or more retailer, or from one or more retailer to one or more consumer, or any combinations thereof.

While the invention has been particularly shown and described with reference to preferred embodiments thereof, it will be understood by those skilled in the art that the foregoing and other changes in form and details may be made therein without departing from the spirit and scope of the invention. The scope of the present invention is not intended to be limited by the specific examples set out herein, but rather is to be interpreted according to the following claims.

What is claimed is:

1. A convenience container device, comprising in combination:

a food container selectively coupled to a lid assembly; said lid assembly including a spoon at an end of a handle, an opposite end of said handle pivotally coupled to a trigger handle;

said food container having an outer wall and at least one food opening, wherein said food container includes:

one or more chambers located in an inner portion of said food container, a first chamber defined by at least one wall, said first chamber having at least one outlet, a second chamber defined by at least one wall, a third chamber defined by at least one wall and said third chamber having at least one outlet;

a tube having a first end and a second end;

an inner portion of said second chamber configured to receive a portion of said first end of said tube, and said tube in selective fluid communication with an inner portion of said third chamber, said third chamber configured to receive a portion of said second end of said tube;

an inner portion of said third chamber in selective communication with said at least one outlet of said first chamber wherein, when a user selectively engages said trigger handle with a single hand to manipulate said spoon, said spoon is selectively displaced along a predefined path from an inner portion of said third chamber through said food opening and thereby conveniently delivers a food mixture of one or more food solids and one or more food fluids to said user.

2. The device of claim 1 wherein said lid assembly further comprises a lid having a guide and at least one pivot on a portion of said lid, said guide configured to manipulate a portion of said handle along said predefined path.

3. The device of claim 2 wherein, each of an opposite end of said handle and an end of said trigger handle couples to a portion of said at least one pivot.

4. The device of claim 3 wherein a portion of said trigger handle couples to a second pivot on a portion of said lid.

5. The device of claim 1 further comprising at least one solid food in an inner portion of said first chamber and at least one fluid food in an inner portion of said second chamber.

6. The device of claim 1 further comprising a mixing region of an inner portion of said third chamber said mixing region configured to receive a portion of at least one solid food from an inner portion of said first chamber and a portion of at least one fluid food from an inner portion of said second chamber.

7. The device of claim 6 wherein said at least one outlet of said first chamber is elevated to prevent displacement of said at least one fluid food from said mixing region into an inner portion of said first chamber thereby maintaining dryness of said at least one solid food located in an inner portion of said first chamber.

8. The device of claim 1 further comprising a portion of an outer surface of said outer wall of said food container sized to receive a portion of said trigger handle.

9. The device of claim 1 wherein a portion of said second end of said tube comprises at least a first bifurcated tube separated from at least a second bifurcated tube, said second end of said tube and said first end of said tube having a substantially Y shape.

10. The device of claim 1 further comprising a portion of a surface of said outer wall of said food container having an indentation, said indentation shaped to receive a portion of an outer surface of a lid assembly of another convenience container device to facilitate efficient stacking of one or more convenience container devices.

11. The device of claim 1 wherein an outer portion of said first chamber comprises a first bifurcated member and a second bifurcated member to facilitate unobstructed movement of a portion of said spoon and said handle between said first bifurcated member and said second bifurcated member of the first chamber along said predefined path.

12. The device of claim 1 further comprising a fourth chamber having an inner channel defined by a portion of a bowl shaped outer wall of said food container, said inner channel in communication with an inner portion of said third chamber, said inner channel configured to receive said food mixture of one or more solid foods and one or more fluids from a mixing region of an inner portion of said third chamber.

13. The device of claim 1 further comprising a separator member, a side of said separator member comprising an inner portion of said first chamber and an opposite side of said separator member comprising an inner portion of said second chamber.

14. The device of claim 1 further comprising a portion of one or more sealant assemblies coupled to a portion of said at least one outlet of said first chamber to hygienically secure one or more solid foods in an inner portion of said first chamber, each of said one or more sealant assemblies having at least one tab configured to selectively decouple a portion of said one or more sealant assemblies from a portion of said at least one outlet of said first chamber.

15. The device of claim 14 wherein a portion of said one or more sealant assemblies is selectively coupled to a portion of said second end of said tube to hygienically secure one or more fluid foods in an inner portion of said second chamber, said at least one tab configured to selectively decouple a portion of said one or more sealant assemblies from a portion of said second end of said tube.

16. A method of dispensing a mixture of solid foods and fluid foods comprising the steps of:

providing a convenience container device having one or more sealant assemblies, said convenience container device including a food container selectively coupled to a lid assembly, said lid assembly including a spoon at an end of a handle, an opposite end of said handle pivotally coupled to a trigger handle, said food container having an outer wall and at least one food opening;

removing a portion of said at least one sealant assemblies from a portion of at least one outlet of a first chamber of said food container to expose one or more food solids located in an inner portion of said first chamber;

removing a portion of said at least one sealant assemblies from a portion of a second end of a tube having a first end in selective fluid communication with one or more fluid foods located in an inner portion of a second chamber to expose said one or more fluid foods;

rotating said convenience container device to facilitate selective dispensing of a portion of said one or more food solids from an inner portion of said first chamber through said at least one outlet of said first chamber into an inner portion of a third chamber;

rotating back said convenience container device to manipulate said one or more solid foods into a mixing region of said third chamber, wherein at least a portion of said spoon is configured to receive a portion of said one or more solid foods;

selectively forcing a portion of said one or more fluid foods from an inner portion of said second chamber through said first end of said tube and out of said second end of said tube into an inner portion of said third chamber to mix with a portion said one or more food solids in said mixing region of said third chamber, a portion of said spoon configured to receive a food mixture of said one or more solid foods and said one or more fluid foods; and selectively engaging said trigger handle with a user's single hand to displace said spoon along a pre-determined path from said mixing region and through said food opening to feed said user with a portion of said food mixture.

17. The method of claim 16 further comprising the steps of:

selectively disengaging said trigger handle, said spoon retracing a portion of said pre-determined path back through said food opening and partially back into an inner portion of said third chamber;

reloading said spoon with a portion of said food mixture located between said mixing region and an inner portion of a fourth chamber in communication with an inner portion of said third chamber; and selectively re-engaging said trigger handle with said user's single hand to re-feed said user with another portion of said food mixture.

18. The method of claim 17 further comprising the step of:

disengaging said trigger handle to retract said spoon into said mixing region of said third chamber.

19. A convenience container device kit comprising, in combination:

at least two convenience container devices wherein each of said convenience container devices is configured to single handedly dispense a mixture of one or more solid foods and one or more fluid foods along a predefined path, each of said at least two convenience container devices including:

a food container selectively coupled to a lid assembly; said lid assembly including a spoon at an end of a handle, an opposite end of said handle pivotally coupled to a trigger handle;

said food container having an outer wall and at least one food opening, wherein said food container includes:

one or more chambers located in an inner portion of said food container, a first chamber defined by at least one wall and said first chamber having at least one outlet, a second chamber defined by at least one wall and, a third chamber defined by at least one wall, said third chamber having at least one outlet;

a tube having a first end and a second end;

an inner portion of said second chamber configured to receive a portion of said first end of said tube, and said tube in selective fluid communication with an inner portion of said third chamber, said inner portion of said third chamber configured to receive a portion of said second end of said tube;

an inner portion of said third chamber in selective communication with said at least one outlet of said first chamber;

a portion of a surface of said outer wall of each food container of said convenience consumer devices having an indentation, said indentation shaped to receive a portion of an outer surface of a lid assembly of another convenience container device;

at least one of said at least two convenience container devices stacked on another convenience container device; and a packaging material proximate to a portion of an outer surface of said at least two convenience container devices to protect said convenience container devices during transportation.

20. The kit of claim 19 wherein said packaging material comprises at least one heat shrinkable plastic to restrain said at least two convenience devices.

* * * * *